US010529156B2

(12) United States Patent
Myers et al.

(10) Patent No.: US 10,529,156 B2
(45) Date of Patent: Jan. 7, 2020

(54) ACCESS CONTROL VIA SELECTIVE DIRECT AND INDIRECT WIRELESS COMMUNICATIONS

(71) Applicant: Delphian Systems, LLC, Buffalo Grove, IL (US)

(72) Inventors: Gary L. Myers, Monee, IL (US); Ashok Hirpara, Carol Stream, IL (US); John D. Veleris, Northbrook, IL (US); Michael Aaron Cohen, Buffalo Grove, IL (US)

(73) Assignee: Delphian Systems, LLC, Buffalo Grove, IL (US)

( * ) Notice: Subject to any disclaimer, the term of this patent is extended or adjusted under 35 U.S.C. 154(b) by 896 days.

(21) Appl. No.: 14/283,127

(22) Filed: May 20, 2014

(65) Prior Publication Data

US 2014/0340196 A1 Nov. 20, 2014

Related U.S. Application Data

(60) Provisional application No. 61/825,245, filed on May 20, 2013.

(51) Int. Cl.
*G07C 9/00* (2006.01)

(52) U.S. Cl.
CPC ..... *G07C 9/00309* (2013.01); *G07C 9/00571* (2013.01); *G07C 2009/00341* (2013.01)

(58) Field of Classification Search
CPC ..... G07C 9/00309; G07C 2009/00341; G07C 2009/00357; G07C 2009/00507;
(Continued)

(56) References Cited

U.S. PATENT DOCUMENTS 4,217,616 A * 8/1980 Jessup ..... H02H 7/0855 307/117
6,927,684 B2 8/2005 Joyner et al.
(Continued)

FOREIGN PATENT DOCUMENTS

JP 2007-316949 A 12/2007
WO WO 02/100040 A1 12/2002
WO WO 2006/136662 A1 12/2006

OTHER PUBLICATIONS

Bluetooth Special Interest Group, "Bluetooth Specification Version 2.1 + EDR [vol. 2]," Chapter 7 Secure Simple Pairing, *Bluetooth SIG, Inc.*, Jul. 26, 2007, pp. 888-906.
(Continued)

*Primary Examiner* — Yong Hang Jiang
(74) *Attorney, Agent, or Firm* — Leydig Voit and Mayer, Ltd.

(57) ABSTRACT

A system is described for controlling a locking system restricting physical access (e.g. a door lock). The locking system is accessed (e.g., actuated and monitored) via dual communication path types used by a mobile wireless communication device. The locking system includes an electro-mechanical access control security device, and a receiving unit controlling the electro-mechanical access control security device. The receiving unit is paired with the mobile wireless communication device for receiving input from the mobile wireless device for activating the electro-mechanical access control security device using both low energy and high energy operating modes. The mobile wireless device is configured to access the locking system via both direct BLUETOOTH and indirect mobile wireless data network communications. Moreover, the operating range of the receiving unit is extended by connections to networked
(Continued)

devices operating BLUETOOTH 4+LE at a high power-extended range mode through the use of an amplifier stage.

8 Claims, 5 Drawing Sheets

(58) Field of Classification Search
CPC ..... G07C 9/00571; G06F 21/88; G06F 1/26; G06F 21/35; G06F 21/81; G06F 2221/2137; G06F 3/0231; G06F 3/03543; H04B 7/00; H04W 12/00503; H04W 12/06; H04W 12/08; H04W 4/023; H04W 4/80
USPC ..... 340/5.61, 5.1, 5.2, 5.64, 5.7, 5.71, 5.72
See application file for complete search history.

(56) References Cited

U.S. PATENT DOCUMENTS

| | | | | |
|---|---|---|---|---|
| 7,012,503 | B2 | 3/2006 | Nielson | |
| 7,873,989 | B2 | 1/2011 | Kärkäs et al. | |
| 8,811,272 | B2 | 8/2014 | Stefan | |
| 9,077,716 | B2 * | 7/2015 | Myers | G07C 9/00103 |
| 9,196,104 | B2 * | 11/2015 | Dumas | G07C 9/00571 |
| 9,292,985 | B2 * | 3/2016 | Ahearn | G07C 9/00309 |
| 2002/0031228 | A1 | 3/2002 | Karkas et al. | |
| 2002/0095588 | A1 | 7/2002 | Shigematsu et al. | |
| 2003/0028625 | A1 * | 2/2003 | Sanjeev | H04L 12/66 709/220 |
| 2003/0207683 | A1 * | 11/2003 | Lempio | H04M 1/72572 455/422.1 |
| 2005/0099262 | A1 | 5/2005 | Childress et al. | |
| 2005/0144318 | A1 * | 6/2005 | Chang | G06F 1/3203 709/245 |
| 2005/0216144 | A1 | 9/2005 | Baldassa | |
| 2006/0143463 | A1 | 6/2006 | Ikeda et al. | |
| 2007/0129030 | A1 * | 6/2007 | Litmanen | H03F 1/0205 455/127.1 |
| 2007/0197261 | A1 | 8/2007 | Humbel | |
| 2007/0300307 | A1 | 12/2007 | Duncan | |
| 2008/0034422 | A1 | 2/2008 | Al-Azzawi | |
| 2008/0177436 | A1 * | 7/2008 | Fortson | G05B 23/0221 701/31.4 |
| 2008/0319665 | A1 | 12/2008 | Berkobin et al. | |
| 2009/0176487 | A1 | 7/2009 | DeMarco | |
| 2010/0255880 | A1 * | 10/2010 | Huang | H04W 4/16 455/558 |
| 2011/0311052 | A1 | 12/2011 | Myers et al. | |
| 2012/0221473 | A1 * | 8/2012 | Redmann | G06Q 30/06 705/50 |

OTHER PUBLICATIONS

European Patent Office, International Search Report and Written Opinion in International Patent Application No. PCT/US2011/040739, Sep. 5, 2011, 12 pp.
International Bureau of WIPO, International Preliminary Report on Patentability in International Application No. PCT/US2011/040739, dated Jan. 3, 2013, 9 pp.
lockitron.com, "Replace your keys with your phone," obtained from Internet site https://lockitron.com/learnmore on May 31, 2011, 1 p.
techcrunch.com, "Lockitron—unlock your door with your phone," obtained from Internet site http://techcrunch.com/2011/05/13/lockitron-lets-you-unlock-your-door-with-your-phone/ on Aug. 29, 2011, 2 pp.

* cited by examiner

ACCESS CONTROL VIA SELECTIVE DIRECT AND INDIRECT WIRELESS COMMUNICATIONS

CROSS-REFERENCE TO RELATED APPLICATIONS

This application claims priority to, and is the non-provisional of U.S. Provisional Application Ser. No. 61/825,245, filed May 20, 2013, entitled "Access Control Via Selective Low and High Energy Short Range Wireless Operation," the contents of which are expressly incorporated herein by reference in their entirety, including any references therein.

This application is related to PCT Application US2012/020632, filed on Jan. 9, 2012, and entitled "System and Method for Access Control Via Mobile Device," the contents of which are expressly incorporated herein by reference in their entirety, including any references therein.

FIELD OF THE INVENTION

This invention relates generally to the field of home security and locking devices and access control, and more specifically to electronically activated access control via mobile wireless communication devices with programmed computer application program execution capabilities.

BACKGROUND OF THE INVENTION

Mechanically and/or electro-mechanically operated locking doors serve an important function in both commercial and residential contexts. More specifically, such locking doors ensure that personnel and/or visitors who are not authorized to access particular premises or secured items are restricted from such access, while providing access to the intended parties.

More recently, controlling access via electro-mechanical locks that are actuated via a wireless signal has become very popular in a variety of user contexts. Such wireless access has been used for decades to control access to vehicles, garages, gates, etc. More recently wireless access has been adopted for a variety of doors and other types of objects for which permanently wired power is not generally available. In those cases, it becomes necessary to provide a locking device/controller combination that consumes substantially lower power so that the locking device/controller can be operated using battery power.

In this regard a BLUETOOTH specification (V4) exists for operating BLUETOOTH devices in a "Low Energy" Core Configuration and in a "Basic Rate and Low Energy" Core Configuration. Such modes of operation can be used to conserve energy in locking devices incorporating BLUETOOTH communications technologies to communicate wirelessly with an external portable locking device controller. Commonly noted in industry as BLE.

It will be appreciated that this background description has been presented to aid the reader in understanding the aspects of the invention, and it is not to be taken as a reference to prior art nor as an indication that any of the indicated problems were themselves appreciated in the art.

BRIEF SUMMARY OF THE INVENTION

It will be appreciated that this background description has been presented to aid the reader in understanding the aspects of the invention, and it is not to be taken as a reference to prior art nor as an indication that any of the indicated problems were themselves appreciated in the art.

Illustrative examples of the invention provide a system for controlling physical access. The system comprises a central security server, a mobile wireless communication device supporting a plurality of wireless communication technologies including: mobile wireless, and short-range wireless. In addition, the system includes an electro-mechanical access control security device (e.g., a deadbolt door lock).

Illustrative embodiments furthermore incorporate actuator devices that operate in a low power state to conserve limited power available from a battery power source. The low power state does not use an amplifier for BLUETOOTH signal transmissions. Thus the power requirements are substantially less when the low power state is utilized. This also limits the ability to transmit over longer distances. Two modes of operation (one with and one without a signal amplification stage) for higher and lower power output enables a pseudo-mesh network including a set of "repeater" nodes that translates to additional reliable BLUETOOTH radio access range between a mobile device and a controlled device.

BRIEF DESCRIPTION OF THE DRAWINGS

While the appended claims set forth the features of the present invention with particularity, the invention and its advantages are best understood from the following detailed description taken in conjunction with the accompanying drawings, of which:

DETAILED DESCRIPTION OF THE DRAWINGS

Figure 1:
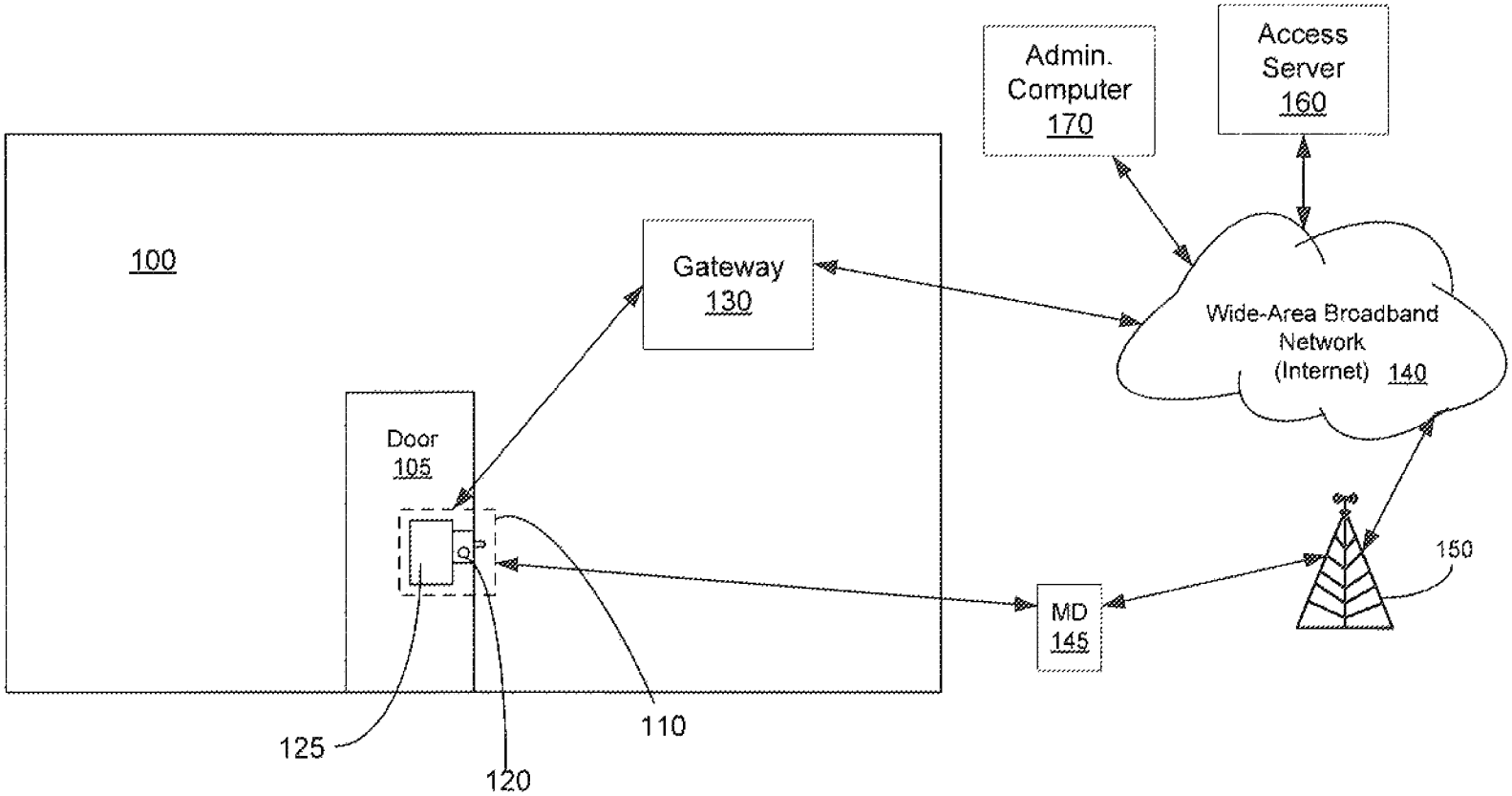
FIG. 1 schematically depicts an exemplary system and environment for controlling access via an electro-mechanical access control security device, such as a door deadbolt unit, or alternatively a secure door, such as a commercial safe or vault, via direct and indirect communications paths using a combination of short-range wireless (e.g., BLUETOOTH) and mobile wireless communications interfaces of a mobile wireless device in accordance with an illustrative example of the invention.

The unique device and method are described herein for accessing (e.g. actuating and determining the status of) an electronic actuator device, such as an electronic deadbolt lock. The mobile wireless devices uses both direct BLUETOOTH communications and indirect communications (via a mobile wireless data network) to provide user access, via the mobile wireless devices, to the actuator device. When the mobile wireless device is within a close range of the actuator device, the mobile wireless device and the actuator device communicate via BLUETOOTH communications protocol interfaces (e.g. BLUETOOTH low energy). However, once the mobile wireless device is outside BLUETOOTH low energy range, the mobile wireless device switches to a second access mode supported by a mobile wireless data network link providing access to the locking device via the Internet and a gateway device. The gateway device supports both a local wireless (BLUETOOTH) and a broadband data network interface. As such the gateway operates as a bridging technology between the Internet and the locking device. The above-described direct (BLUETOOTH) and indirect (mobile wireless data network) communications modes are discussed further herein.

The system and method facilitate automated actuation of, for example, a door lock without having a user physically actuate an interface with the lock. The device may be a key, a key fob (remotes), card, RFID and so on. These methods are well defined in the industry today. Known communication protocols support connection methods with wireless devices without having physical tactile user interface on a routine or required basis. This is exemplified by devices such as a Bluetooth wireless computer mouse. These devices, once paired with a base station, can be moved "out of range" of typical Bluetooth signal strengths and then brought back into range and the connection is made automatically. This is also exemplified in automobiles having Bluetooth connectivity for receiving audio files.

The described systems and methods incorporate functionality that permits a door to open when a Bluetooth enabled mobile device comes into range (very close proximity), and lock when the device is out of a range of close proximity to the lock. The typical Bluetooth-enabled mobile wireless device is a mobile wireless phone or any other portable/mobile wireless device that can be easily/conveniently carried by a user.

Importantly, BLUETOOTH technologies can now operate in a mode using very low energy over time. This Core Bluetooth technology is called V4+LE. The V4 operating mode of Bluetooth however has limitations since the low energy consumption mode has a very limited transmission range.

While limited transmission range is an advantage for simple door locking/unlocking operations, it severely limits the ability to communicate to other devices at distances that are typically encountered in a home environment. Having a range that can "cover" a distance in a typical home environment gives the door and other Bluetooth devices a unique characteristic. By installing a Blue Tooth/mesh network interface to Wi-Fi, GSM. CDMA or Ethernet gateway and designing the appropriate interface for the web and/or phone the locking device status can be monitored, or even operated, from remote locations.

To address the above-summarized "range" problem for Bluetooth wireless control of actuator devices, "dual range mode" of operation of a locking device is described herein. The dual operating modes allow both the low energy V4 and high energy V2 Bluetooth Core or mesh network technologies to work on a selectable power consumption level based upon a given situation (e.g., battery or continuous power) or need. Thus the advantage of low energy consumption for battery conservation is possible and/or the higher power consumption mode of operating the BLUETOOTH interface (i.e., incorporating an amplifier circuit between a BLUETOOTH chip (signal source) and a transmitting antenna of the BLUETOOTH enabled locking device. The enhanced range provided by the higher power consumption mode of operation of the actuator (locking) device can be utilized to allow access/egress or checking conditional states of operation of the actuatable device. In a specific example (see FIG. 4), locking devices powered by a continuous power source operate in the high power (enhanced transmission range) BLUETOOTH transmission mode while operating as "repeater" nodes that provide BLUETOOTH access between a mobile wireless device and a battery-powered BLUETOOTH-enabled locking device operating in a low power (smaller transmission range) mode.

Turning to FIG. 1, an illustrative example is provided of an environment incorporating the dual (direct/indirect) access technology introduced above. In the illustrative example, a building 100 includes a door 105 and a locking system 110 that limit access to the interior of the building when the locking system 110 is locked. The locking system 110, by way of example, comprises an electro-mechanical deadbolt lock 120. In addition to providing access via physical key, the electro-mechanical deadbolt lock 120 is actuatable via an electronic motor drive circuit under control of signals provided by an electronic receiver controller 125 incorporated into the locking system 110. A more detailed view of electronic receiver controller 125 of the locking system 110 is provided in FIG. 3 described herein below.

The operating environment depicted in FIG. 1 also includes a gateway 130. The gateway 130 operates as a bridge between BLUETOOTH communications (on the locking device side) and broadband data network communications over the Internet 140 providing connectivity to a variety of remote components of the system. By way of example, the gateway 130 operates a BLUETOOTH interface operating in a high power consumption (enhanced signal transmission range) mode. The gateway 130 also includes an Ethernet interface through which the gateway connects to the access server 160 via the Internet 140.

Notably, the operating environment depicted in FIG. 1 includes a mobile wireless device (MD) 145 that is configured with both: (1) a BLUETOOTH interface supporting direct communications (once paired) between the MD 145 and the locking system 110, and (2) a mobile wireless data network interface supporting indirect communications between the MD 145 and the locking system 110 via a broadband data network connection supported by a mobile wireless data network service provider 150 (represented by a cell tower in the drawing). Depending upon the particular configuration and capabilities of the gateway 130 the mobile device 145 may communicate with the locking system 110 via a connection supported by the gateway 130. However, an access server 160 operates as an intermediate repository of message/data transmissions between the MD 145 and the locking system 110. To that end, the access server 160 maintains records within a connection table for each supported MD/locking device "connection." The access server 160 thus facilitates the above-mentioned "indirect" access mode between the locking system 110 and the MD 145. Moreover, the data exchange via the indirect method is permitted only through the use of revolving security "token" packets. These packets are very short and operate in a burst or fast transmit state. The packets "match" allows the encryption scheme to run. This encryption/security scheme keeps the system response fast.

By way of example, the set of actions that the MD 145 can validly request from the access server 160 are limited to determining a status (locked/unlocked) of the locking system 110. Operating commands (e.g., lock and unlock) are limited to the direct operational mode. However, in an alternative embodiment, the indirect communication mode can be used to operate the locking system 110 after confirming, by reading the Global Positioning System (GPS) coordinates of the MD 145, the MD 145 is within a configured/configurable distance of the locking system 110. The access server 160, in addition to operating as a messaging service intermediary between the MD 145 and the locking system 110, maintains an audit trail of each access made from identified devices/users in the form of time stamped access events.

Also depicted in FIG. 1, a networked administrative computer 170 accesses (via Internet data network service providers) the locking system 110 via the access server 160. Such access may be limited to determining/monitoring the current status of the locking system 110, and may be expanded to reviewing an audit trail containing a listing of time stamped access events (lock, unlock, requested status, etc.). Moreover, the functionality of the networked administrative computer 170 is expanded to include operating command capabilities. Such access may be needed on an emergency basis in response to a call-in request from a user of the locking system 110 that is unable to actuate the locking system 110 (e.g. lost key or mobile wireless device). Thus, in the illustrative example, the access server 160 operates as a manager of access policies governing the operation of the locking system 110 and other wirelessly controlled actuatable devices via indirect communications between mobile wireless devices and locking devices of interest.

Figure 3:
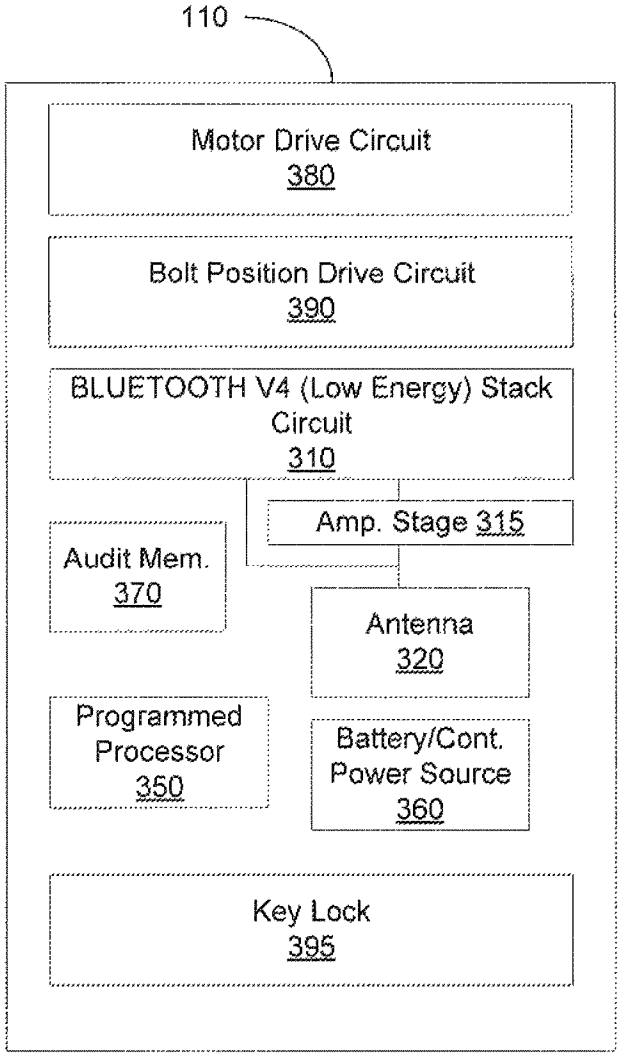
FIG. 3 schematically depicts functional components of a locking system incorporating a BLUETOOTH wireless interface.
Figure 2:
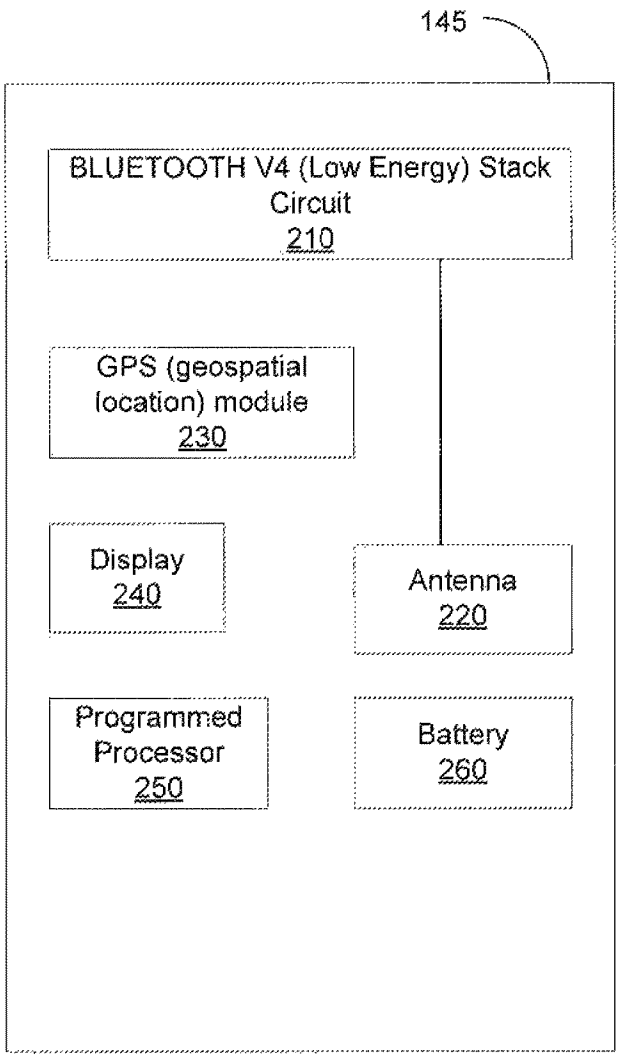
FIG. 2 schematically depicts functional components of a mobile wireless device incorporating both a BLUETOOTH wireless interface and a mobile wireless interface provide direct and indirect paths for accessing the locking system schematically depicted in FIG. 3.

Turning to FIG. 2, functional components of the MD 145 incorporating both a BLUETOOTH wireless interface and a mobile wireless interface provide a support for direct and indirect paths for accessing the locking system schematically depicted in FIG. 3. In the illustrative example, a BLUETOOTH V4 (low energy) stack circuit 210 drives an antenna 220 configured to operate within the low power transmission mode generally assigned to battery-powered devices. The illustrative components of the MD 145 also include a geospatial location module 230 configured to determine, within a few feet, a current location of the MD 145. By way of example, the geospatial location module 230 is configured to operate with the Global Positioning System (GPS). However other geospatial location systems are also used. The geospatial location module 230 is used in conjunction with a commissioning procedure wherein geospatial location coordinates are established for the locking system 110. Thereafter, a comparison of the geospatial coordinates of the locking system 110 are compared to the coordinates of the MD 145 to determine whether the distance between the two devices is within a configured/configurable range to initiate unlocking the locking system 110. Similarly, the comparison of location coordinates is used to automatically initiate locking the locking system 110 when a calculated distance exceeds a configured/configurable automatic locking distance.

With continued reference to FIG. 2, a display 240, driven by an application/applet running in the background of a programmed processor 250 of the MD 145, presents information (e.g., locking device status) and command entry prompts (e.g., confirm unlock/lock operation). As those skilled in the art will readily appreciate a variety of configuration and operation interfaces are potentially supported by the display 240. Lastly, a battery 260 is depicted that supplies the power for the various components of the MD 145 depicted in FIG. 2.

Turning to FIG. 3, functional components of the locking system 110 incorporating a BLUETOOTH wireless interface are depicted. In the illustrative example, a BLUETOOTH V4 (low energy) stack circuit 310 drives an antenna 320 configured to operate within the low power transmission mode generally assigned to battery-powered devices.

In accordance with an illustrative example depicted in FIG. 3, a wirelessly controlled locking system device (either an actual locking device or a bare "repeater" node) is potentially connected to continuous power supply (as opposed being powered solely by a battery). In such case, the locking system 110 operates in a high power mode of operation, when connected to a continuous power source, wherein output from the BLUETOOTH V4 stack circuit 310 passes through an amplifier stage 315 before transmission via the antenna 320. In general, when the locking device 110 operates on battery power via the power source 360, the amplifier stage 315 is disconnected from power and the signal from the BLUETOOTH V4 stack circuit 310 passes directly to the antenna 320. However, when the locking device 110 power source 360 is connected to continuous power, the output from the BLUETOOTH V4 stack circuit 310 passes through the amplifier stage 315 thereby increasing the transmission range of the BLUETOOTH signal interface of the locking system 110 (or repeater device).

With continued reference to FIG. 3, a programmed processor 350 of the locking system provides overall control of the operation of the locking system 110. The programmed processor 350 runs interface applets/applications that result in actuation of a physical locking component (e.g. deadbolt) of the locking device 110 and recording such events within an audit memory 370. With regard to the mechanical elements of the locking system 110, motor drive circuit 380 and a bolt position drive circuit 390 cooperatively operate, under control of the programmed processor 350, to actuate the deadbolt of the exemplary locking system 110. Lastly, a key lock 395 is provided as an alternative to using the electronic driving components of the locking system 110.

Having described the general operation of an exemplary system and primary components of such system. Attention is now directed to an enhancement to the illustrative environment depicted in FIG. 1. By way of background, one of the primary functions of the multiple supported modes of communication between an electro-mechanical locking device controller and a mobile wireless device is to extend a range of common Bluetooth signals. The Federal Communication Commission limits the output power of BLUETOOTH signal transmitters. The described examples use additional network structures to operate as repeater nodes between a device controller operating at low power and a mobile wireless device. The network structures operating as repeater nodes, through the use of amplifiers, transmit a relatively high power BLUETOOTH signal when the networked structures are connected to a non-interrupted continuous power source. Typically this is an A/C source converted to D/C. The radio operates with an amplifier that has been impedance matched to the chipset radio and the antenna to provide signal amplification without signal quality degradation. Amplifying the BLUETOOTH signal allows the signal to carry data packets in a linear form. This Linearity allows the data packets to maintain integrity over longer distances while still adhering to the FCC DB power guidelines.

Figure 4:
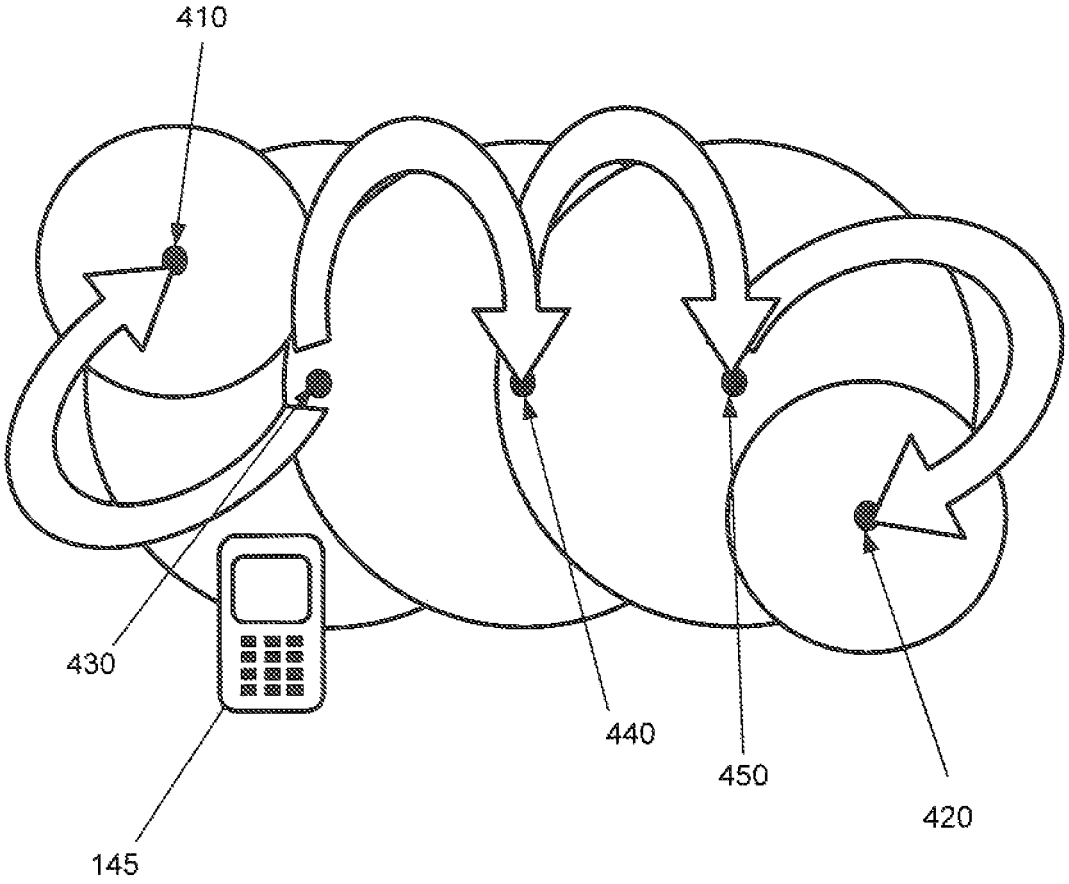
FIG. 4 schematically depicts a range extending network topology incorporating both low power (battery powered) locking devices having normal BLUETOOTH wireless range and high power (continuous power source) repeater devices having extended BLUETOOTH wireless range.

FIG. 4 schematically depicts a range extending network topology incorporating both low power (battery powered) locking devices having normal BLUETOOTH wireless range and high power (continuous power source) repeater devices having extended BLUETOOTH wireless range. In particular, FIG. 4 depicts an enhanced system that utilizes/leverages high power operation mode of locking devices, such as the locking system 110 depicted in FIG. 3.

With continued reference to FIG. 4, small circles surrounding devices 410 and 420 represent the relatively limited BLUETOOTH range for these actuatable/locking devices, such as locking system 110, operating in the "battery" power mode wherein the output of the BLUETOOTH V4 stack circuit 310 passes directly to the antenna 320 without any further amplification. However, the larger circles surrounding devices 430, 440 and 450, represent the extended BLUETOOTH signal ranges supported by actuatable/locking devices, such as locking system 110, operating in the "continuous" power mode wherein the output of the BLUETOOTH V4 stack circuit 310 passes through the amplifier 315 prior to transmission by the antenna 320. Moreover, while operating in the "continuous" power mode, the devices 430, 440 and 450 operate as "repeaters" on behalf of the MD and any reachable locking device, including devices 410 and 420 that operate in the "battery" mode and would otherwise not be reachable by the MD 145 at its current location. In this expanded BLUETOOTH range architecture, the MD 145 communicates with the device 410 via the device 430. The MD 145 also communicates with the device 420 via intermediate "hops" through devices 430, 440 and 450. As such, the effective range for direct (non-Internet) communications is significantly enhanced by the additional signal range and repeater functionality supported by the devices 430, 440 and 450 operating in the high power transmission mode.

Figure 5:
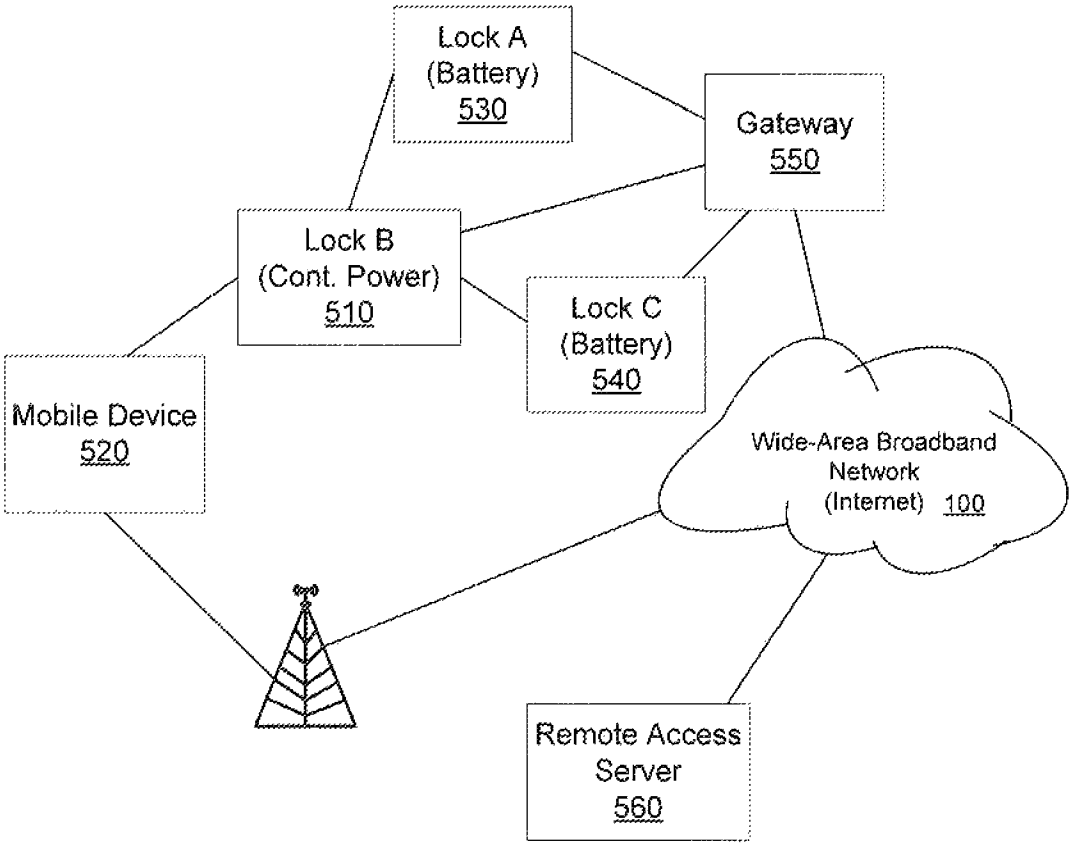
FIG. 5 schematically depicts an exemplary networked environment wherein dual modes of accessing the locking system depicted in FIG. 2 using the mobile wireless device depicted in FIG. 3 is enhanced by a continuously powered locking device that operates in a high transmission power mode to provide extended direct (BLUETOOTH) access between a mobile wireless device and battery powered locking devices that operate in a low transmission power mode.

Having described, with reference to FIG. 4, the general functionality and operation of an extended range BLUETOOTH network, using BLUETOOTH devices (connected to continuous power and operating in high power BLUETOOTH mode) as repeater nodes, attention is directed to FIG. 5. In FIG. 5, a network view schematically depicts an exemplary networked environment wherein dual access modes for accessing the locking system, such as the one depicted 110 in FIG. 1, is enhanced by a continuously powered locking device 510 that operates in a high transmission power mode to provide extended direct (BLUETOOTH) access between a mobile wireless device 520 and battery powered locking devices 530 and 540 that operate in a low transmission power mode. A gateway 550 is also provided. However, the secondary path (via the gateway 550 and remote access server 560) need not be used to obtain status information regarding devices 530 and 540, in cases where the mobile device 520 is within the extended BLUETOOTH range of the locking device 510. In such case the locking device 510 carries out a secondary function as a repeater node for BLUETOOTH communications between the mobile wireless device 520 and the battery powered locking devices 530 and 540.

Figure 6:
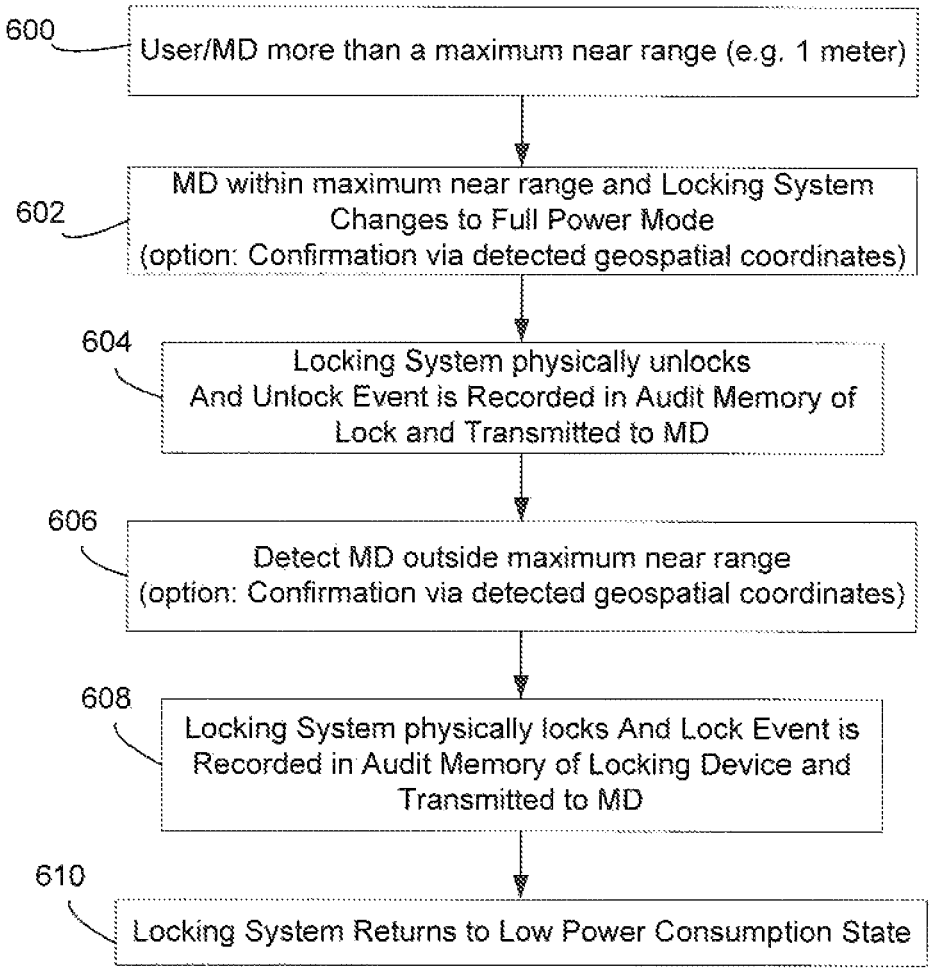
FIG. 6 is a flowchart summarizing a set of operational states/stages associated with operation of a locking device of the type depicted in FIG. 2 communicating with a mobile wireless device of the type depicted in FIG. 3.

FIG. 6 summarizes a set of operational states/stages associated with operation of a locking device of the type depicted in FIG. 2 communicating within BLUETOOTH range (and in fact well within such range) with a mobile wireless device of the type depicted in FIG. 3. During stage 600, the mobile device and a paired locking device are both in a relatively low power BLUETOOTH communications state. However, during stage 602, when the MD 145 enters within a maximum near range field of the locking system 110, both devices enter a first high energy BLUETOOTH communications state for a lock and a paired mobile phone using Bluetooth direct communications.

Ranging technology is not nearly perfect in operation. A proximity detector based upon a detected distance between a locking device and the mobile wireless device 145 sometimes can misfire or not function smoothly for the user. This can be identified as a failure to open. This failure often comes from the actuatable device not "seeing" the signal. This is due to a variety of reasons (e.g., interference etc). Therefore, a secondary method is incorporated in the mobile wireless device (cell phone). The V4 core functionality is supposed to open the application in the background, identify the lock (device) and operate. Bluetooth is provided with a SPY output to facilitate this operation. A GPS location service is also incorporated into the mobile device that allows the mobile device to start the application in anticipation of proximity to the actuatable device (e.g. lock), and alternately, notify the user that they left the door open. By using the connect features of V4 and the location services it is possible to send notifications to the user. After the notification the user then can "operate/control" the device locally or take whatever action he/she desires.

Thus, in accordance with an illustrative example, during stage 602 the MD 145 compares current geospatial coordinates with a configured set of coordinates for the locking system 110 to confirm that the two devices are indeed within the near range distance. Such distance is configurable and can be from a few feet to several times such distance.

Thereafter, during stage 604 the locking system 110, in response to a command issued by the MD 145, actuates the deadbolt to an unlocked position. The unlocking event is recorded in the audit memory 370 of the locking system 110. The unlock event is communicated via the BLUETOOTH interface to the MD 145. Upon receipt of the event message, the MD 145 wakes an interface application that displays a confirmation on the display 240 of the MD 145.

Thereafter, during stage 606, the MD 145 is detected as being outside a configured/configurable maximum near range for maintaining the locking device 110 in an unlocked state. In an illustrative embodiment detection of such status is redundantly confirmed by both local sensors on the locking system 110 and by comparison of geospatial coordinates of the MD 145 and the locking system 110.

In response to the detected separation between the MD 145 and the locking system 110, during stage 608 the locking system actuates the deadbolt to a locked position. The locking event is recorded in the audit memory 370 (or an alarm condition is entered if the locking event cannot be completed) of the locking system 110. The lock event is communicated via the BLUETOOTH interface to the MD 145. Upon receipt of the event message, the MD 145 wakes an interface application that displays a confirmation on the display 240 (e.g. "Device X locked"). Thereafter, at stage 610 the locking system 110 returns to a low power consumption state.

The described method and device incorporate several levels of wireless security. When operated in the dual mode the security can be quite extensive. In addition to security levels that are controlled via specialized encryption schemes there is an option that in the local mode the device permits an administrator to "switch off" the discovery mode in the Bluetooth stack. Once the "users" have been registered within the lock device, the administrator turns the discovery mode off in the local mode. This prevents a "hacker"/"thief"

from gaining access since they cannot "pick" a secure list of authorized users when the list editing functionality is turned OFF.

As for other modes of operation(s), there are two distinct modes. These modes can be used for a variety of controls or feedback. Due to the problem associated with attempting to control devices from remote locations a feedback message path is highly desired. The environment that the lock or device is in cannot be anticipated by all electronic methods. So the mobile device incorporating Bluetooth-based actuation signal technology incorporates a variety of feedback sensors that monitor physical activities. This can be exemplified in the use of automobile remote access control devices. In particular, if a user asks to have his/her car door operated remotely, the primary system controller "locks" the door to prevent user interface that may cause variations that cannot be anticipated by sensors. So in this case the locking mechanism uses digital monitoring throughout all motion. Thus the user can interface as if they were proximate the controlled locking device.

The operation as mentioned earlier can be carried out "locally" or "remotely." In the local (ad hoc) operational mode, a mobile wireless device incorporating Bluetooth technology is "paired" or "learned" by an actuatable device that communicates via BLUETOOTH low energy technology. The BLE radio stack also allows a No Pair functionality in which the mobile wireless device learns the "lock's" unique pairing code. This is performed at the API level. After this learning sequence the device can operate in at least two distinct modes/ways. In one way the user starts an application on the mobile wireless device (e.g. mobile wireless phone) and then actuates the actuatable device using this application using the device screen interface on the mobile wireless device. This mode of operation typically uses Core V2. While V4 is rapidly anticipated to replace V2, legacy devices still will exist for several years.

The other local (ad hoc) operational mode uses the Core V4 wherein the user still needs to pair the mobile device with the actuatable device. However, after this operation, a different way of communicating an actuation command to the actuatable device is used. When the V4 device comes into range the device "lock" will operate or be allowed to be polled for conditional responses.

Since the ranging technology is not nearly perfect in operation. It sometimes can misfire or not function smoothly for the user. This can be identified as a failure to open. This failure often comes from the actuatable device not "seeing" the signal. This is due to a variety of reasons (e.g., interference etc). Therefore, a secondary method is incorporated in the mobile wireless device (cell phone). The V4 core functionality is supposed to open the application in the background identify the lock (device) and operate. Bluetooth is provided with a SPY output to facilitate this. A GPS location service is also incorporated into the mobile device that allows the mobile device to start the application in anticipation of proximity to the actuatable device (e.g. lock), and alternately, notify the user that they left the door open. By using the connect features of V4 and the location services it is possible to send notifications to the user. After the notification is received by the MD 145, the user then can "operate/control" the device locally or take whatever action he/she desires.

In the remote operational mode, the phone itself is used as a "master" device to enable the mobile wireless device to operate the actuatable device (e.g. door lock) and an actual Blue Tooth to Ethernet or mesh network device/gateway. This gateway can function in a home as a communication device to the actuatable device (door lock). This allows the actuatable device to be monitored or operated from a remote terminal and/or the actual device (phone) so this offers three methods of operation.

As will be appreciated by those skilled in the art, setup is accomplished by "learning" or syncing each module into a table. This is similar to a mesh network in that the envelope of operation is determined in advance of operation by the "learning" or "sync" mode when initialized. The phone or remote will operate as the mobile device to capture the nodes and devices. This will facilitate a method incorporating security between the system devices.

The access modes described herein below are contemplated for various mobile devices to an actuatable device having a Bluetooth interface in accordance with the above-described functionality depicted in the drawings:

FULL ACCESS=When the Phone Application is set on full access the dead bolt door lock will open automatically as the mobile device approaches the Bluetooth enabled wirelessly actuatable lock. The user may select an operational distance via an application on the mobile device (e.g. smart phone). The user can alternately use the smart phone application to manually press the OPEN button on the screen. LED's indicate the functions visually on the lock and a beeper sounds providing an audible feedback.

SEMI ACCESS=When the Phone application is set on semi access the dead bolt will unlock by pressing the exterior button on the lock while the phone is in range of the lock. The Blue Led lights up telling the User the lock is capable of opening via the exterior button. The User can select the distance the Blue Led is turned on via the phone application. Again the lock LED's and beeper work the same as Full access. The phone also serves again to allow manual operation via the screen.

MANUAL=When the Phone application is set on Manual the deadbolt will not move electrically. However the LED's and beeper still announce the lock and open conditions.

FULL EGRESS=When the application is set to full egress the lock will automatically lock as the mobile device that caused the lock to open moves out of range. The range (distance) is set by the phone application. The phone can also lock the lock via pressing the screen button. The beeper sounds and the LED's indicate device conditions/position.

SEMI EGRESS=When the application is set to semi egress the lock will not automatically lock regardless of distance (the phone is not required). The lock requires the User to press the exterior or interior button on the lock. The lock waits a certain amount of time and then locks. The beeper sounds and the LED's indicate device conditions/position.

A limitation in past Bluetooth-based wireless actuator activation (open/close) is activation range. The issue of activation range (the need for more) is overcome in the part by the use of Wi-Fi "mesh" networking. These "mesh" networks again are proprietary in nature. However, according to the disclosure herein, the "mesh" network problem is overcome with a two prong approach. First the BLUETOOTH 4+LE stack will communicate to any other BLUETOOTH 4+LE stack device. Second, if there is no device with a BLUETOOTH 4+LE stack in range, an extender module which may or may not be an actuator device, can be added to link up a series of connected BLUETOOTH devices to create a series of hops between a target actuatable device and a mobile wireless device. The extender/repeater node uses a common "mesh" network interface. The extenders/repeaters may transmit through a gateway device that utilizes both a Bluetooth Low energy chipset as well as a "mesh" network chipset. This approach permits seamless communication as the user of the MD 145 moves about in range. This approach eliminates the need to subscribe to a private network. Furthermore, this approach enables manufacturers to operate their own independent servers/services.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Illustrative examples of this invention are described herein, including the best mode known to the inventors for carrying out the invention. Variations of those preferred illustrative examples may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An access control system for controlling physical access via communications with a wireless communication device, the access control system comprising:

an electro-mechanical access control security device; and a receiving unit for controlling actuation of the electro-mechanical access control security device, wherein the receiving unit is adapted to be paired with a host on the wireless communication device to communicate via Bluetooth communications;

wherein the receiving unit is adapted for receiving, after pairing with the host, user commands from the paired host for the electro-mechanical access control security device via the Bluetooth communications;

wherein the receiving unit is adapted to selectively operate in one of a plurality of Bluetooth communications energy consumption modes including:

a low energy consumption mode, and a high energy consumption mode; and wherein the system selects the high energy consumption mode based upon a current proximity status of the wireless communications device with respect to the access control system.

2. The system of claim 1 wherein the receiving unit is coupled to a network component facilitating remote access via the Internet.

3. The system of claim 1 wherein a range of the receiving unit is extended by integration of a low energy radio signal output of a communications protocol chip with an amplifier circuit interposed between the communications protocol chip and an antenna.

4. The system of claim 2 wherein the network component is a gateway.

5. The system of claim 2 wherein the network component is an extender.

6. The system of claim 2 wherein the network component is part of a mesh network.

7. The system of claim 1 wherein the access control system operates on DC power converted from power received in the form of continuous A/C power.

8. The system of claim 1 wherein communications between the security device and the mobile wireless communications device are supported via at least a direct communication path and an indirect communication path.

* * * * *